US006921421B2

(12) United States Patent
Gailey et al.

(10) Patent No.: US 6,921,421 B2
(45) Date of Patent: Jul. 26, 2005

(54) PRODUCING DYED THREAD

(75) Inventors: Robert McNaught Gailey, Strathclyde (GB); Alexander David Scrimgeour, Strathclyde (GB)

(73) Assignee: J&P Coats Limited, Glasgow (GB)

( * ) Notice: Subject to any disclaimer, the term of this patent is extended or adjusted under 35 U.S.C. 154(b) by 99 days.

(21) Appl. No.: 10/187,585

(22) Filed: Jul. 2, 2002

(65) Prior Publication Data

US 2003/0056299 A1 Mar. 27, 2003

Related U.S. Application Data

(63) Continuation of application No. PCT/GB01/00053, filed on Jan. 8, 2001.

(30) Foreign Application Priority Data

Jan. 6, 2000 (GB) ..... 0000172
Jan. 11, 2000 (GB) ..... 0000416

(51) Int. Cl.[7] ..... D06B 5/16
(52) U.S. Cl. ..... 8/151.2; 68/189
(58) Field of Search ..... 68/189, 198; 8/151.2

(56) References Cited

U.S. PATENT DOCUMENTS 1,775,543 A * 9/1930 Abbott ..... 8/618
1,973,953 A * 9/1934 Gordon ..... 8/155.1
2,086,100 A * 7/1937 William ..... 8/198
2,513,418 A * 7/1950 MacNeill ..... 8/155.1
2,726,827 A * 12/1955 Ammerall ..... 242/157 R
2,746,280 A * 5/1956 Russell ..... 68/198
2,904,954 A * 9/1959 Houser ..... 57/2
3,938,952 A * 2/1976 McNeill ..... 8/149
4,272,037 A * 6/1981 Becker et al. ..... 242/118.1
4,304,048 A 12/1981 Smith et al.
4,379,529 A * 4/1983 Nielsen ..... 242/118.11
4,491,286 A * 1/1985 Nielsen ..... 242/118.1
4,545,222 A * 10/1985 Rost ..... 68/198
4,583,988 A * 4/1986 Muller et al. ..... 8/543
4,685,284 A 8/1987 Philipp et al.
4,720,986 A * 1/1988 Fuchs et al. ..... 68/198
5,351,351 A * 10/1994 Ono ..... 8/155.1
5,617,748 A 4/1997 Wise et al.
5,709,072 A * 1/1998 Hasenack et al. ..... 57/67
6,094,947 A * 8/2000 Scatizzi ..... 68/27
6,405,568 B1 * 6/2002 Bellini ..... 68/10

FOREIGN PATENT DOCUMENTS

GB 1095343 12/1967
JP 3-130459 * 6/1991
RU 2004488 C1 12/1993

OTHER PUBLICATIONS

International Searching Authority, PCT Notification of Transmittal of the International Search Report for PCT/GB 01/00053.

* cited by examiner

*Primary Examiner*—Frankie L. Stinson
(74) *Attorney, Agent, or Firm*—Alston & Bird LLP

(57) ABSTRACT

There is disclosed a method for producing a package of dyed thread, comprising: producing a package of undyed thread on a user package support which is dye permeable; and dyeing the thread on the user package support to produce a user package of dye thread; the package being wound so as to be suitable both for dying and orderly unwinding in use.

16 Claims, 2 Drawing Sheets

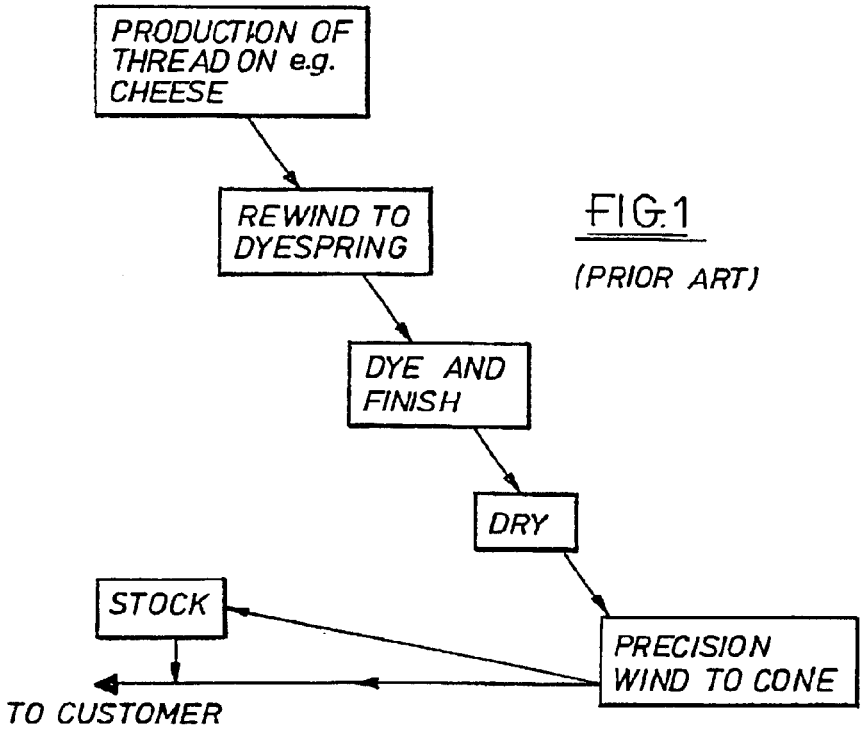
FIG.1
(PRIOR ART)
FIG.2
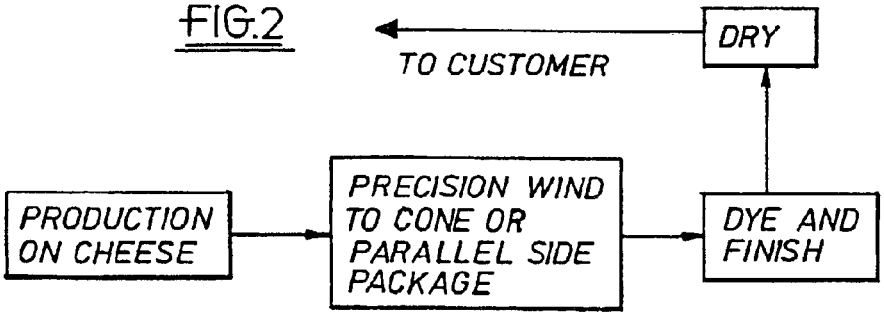

PRODUCING DYED THREAD

This is a continuation of application Ser. No. PCT/GB01/00053, filed Jan. 8, 2001.

This invention relates to producing dyed thread, particularly, but not necessarily, sewing thread.

Thread is usually, though not necessarily, dyed on a dye package, which consists of a perforated metal or plastic material centre, or a dye spring, made of wire, with the thread wound thereon. The thread is wound with open lay, ie. adjacent threads separated from one another, and with a uniform, low tension. For sewing threads, the density of the thread on a package is usually arranged to lie between 0.4 and 0.5 grams per cubic centimetre.

These dye packages, after dyeing, must be rewound on to packages which are more tightly wound, with the threads laid close together with a high degree of regularity (close lay).

Particularly during machine sewing operations, but also during knitting and weaving, the thread is drawn off the package intermittently, and, if it is not tightly wound, there is a tendency for the thread to snag on loosened thread loops.

Each winding operation directly adds materially to the cost of the thread. Moreover, there are indirect costs involved in that the production time is longer, the more operations are performed, and the increased delay between purchase of raw materials and sale of finished product requires extra working capital.

The present invention provides improved ways of producing dyed thread that address these concerns.

The invention comprises a method for producing a package of dyed thread, comprising:

- producing a package of undyed thread on a user package support which is dye permeable; and
- dyeing the thread on the user package support to produce a user package of dyed thread;
- the package being wound so as to be suitable both for dyeing and orderly unwinding in use.

The package may be wound at a density intermediate the densities of a normal dye package and a precision wound user package.

The package may be wound as a precision wound package.

The user package support may comprise a perforated cone, or a perforated parallel sided spool, in which latter case it may comprise a plurality of endwise-connected parallel sided spools on which adjacent packages are wound and which are readily separable into individual packages after dyeing.

The user package support may be reusable, and may be suitable for radio frequency heating for drying the package after dyeing.

The user package support may be of plastics material or of metal.

The package may be wound to a density of up to 0.8 grams per cubic centimetre, say between 0.7 and 0.8 grams per cubic centimetre, and the wound package preferably has a circumference of at least 160 mm.

The thread may be twice dyed, the second dyeing, at least, being effected on the user package support—this is useful for recovering unwanted inventory of already dyed thread which, otherwise, would be scrapped, the usual processes inherent in recovery, involving multiple rewindings, being not only expensive, but also introducing too many knots for commercial use.

The application of finish to the thread may also be combined with the dyeing operation, either performed during dyeing or afterwards with the thread still on the user package support Methods for dyeing according to the invention will now be described with reference to the accompanying drawings, in which:

FIG. 1 is a block diagram showing a prior art dyeing process;

FIG. 2 is a block diagram showing the method according to the invention;

FIG. 3 is an elevation of a first user package support, with an outline of the package shape;

FIG. 4 is a like elevation of a second user package support;

FIG. 5 is a like elevation of a third such support;

FIG. 6 is an elevation of a stack of parallel sided packages; and

FIG. 7 is an elevation of a stack of conical packages on a package dyeing machine spindle.

The drawings illustrate methods for dyeing threads, comprising:

- producing a package 11 of undyed thread on a user package support 12 which is dye permeable; and
- dyeing the thread on the user package support 12 to produce a user package of dyed thread;
- the package 11 being wound so as to be suitable both for dyeing and orderly unwinding in use.

FIG. 1 illustrates a prior art method for producing dyed sewing thread. Undyed thread is first produced on large packages called cheeses. These are rewound onto dyesprings or perforated cores into loosely wound open lay packages suitable for dyeing. These dye packages are loaded on to spindles of package dyeing machines and dyed. The dyed packages are dried, and then rewound into precision wound cones, which may be supplied direct to the end user, or, more usually, are taken into stock for supply to a customer as and when the colour is requested. Unless a particular colour is in stock, it could take quite some time to produce it—stocks of undyed thread are not normally held on dyesprings, and so the production will involve two winding operations, staring from cheeses.

By contrast, the method of the invention, illustrated in FIG. 2, involves the initial production of the cheese, then a precision winding operation on to the dyeing-compatible package 11, followed by the dyeing operation, in which, or after which, with the thread still on the package 11, a finish may be applied, saving even more time and cost. Dyeing is followed by drying, which may be done by radio frequency heating, a plastics material package support being suitable for this, being transparent to radio frequencies. The thread is now ready for shipping to the end user. None need be taken into stock, as there is no need to carry out any further processing, and batches may be made up of any size and in a very short production time. This facilitates "just in time", or JIT, production, with both capital and operational-savings, and increased customer satisfaction due to the rapid response time made possible by the method.

FIGS. 3, 4 and 5 illustrate various types of user package support 12 that can be employed in the method, FIG. 3 being a conventional cone shape for precision cone winding, FIG. 4 showing a parallel sided version, and FIG. 5 showing a part conical, part parallel shape. In all, cases, the shape of package 11 wound on them is indicated in ghost lines. All three supports 11 have perforations 13 and are conveniently moulded in plastics material which is transparent to radio frequency as might be used to dry the dye packages. The perforations are designed to give adequate penetration for the dye liquor while leaving the support 12 adequately strong and resistant to bending, buckling or fracture under the, usually hot, dyeing conditions and under the hoop stress due to the winding tension of the thread.

FIG. 6 illustrates the use of an multiple package user package support 61 comprising multiple individual supports 12 joined together—as by each support 12 having an end part which is a close fit into an opposite end part of another. Individual packages 11 are wound side by side on the supports 12, say three at a time, then assembled into a longer stack depending on the dimensions of an available dyeing machine. The longer stack is then threaded on to a package dyeing machine spindle for loading into the dyeing machine. The dyed packages are separated after dyeing and drying.

FIG. 7 illustrates how a plurality of cones 11 can be stacked, with intervening metal separator discs 71, preventing contact between adjacent packages, to the same end. Screwed end pieces, not shown, may secure the assembly, if necessary. It is also, of course, possible to stack cones without the separator discs.

While different winding conditions may be appropriate to different types of thread, it is found that with sewing threads, a precision wound package, wound to a density of 0.7 to 0.8 grams per cubic centimetre, and having a minimum circumference no less than 160 mm is ideal, both for dyeing and for unwinding during machine sewing use.

It is very surprising that a single package can serve both as a dye package and as a user package. It has been axiomatic in the textile industry that dyed packages have to be rewound before use, because of the softness of the wind required for good dye penetration, or disturbances due to dye circulation, or both. The cost benefits flowing from the invention are substantial. The user package supports 12, moreover, are reusable, representing a further cost saving, but, more particularly, eliminating the need to send the prior art fibre cones to waste.

For JIT production, the thread can be held in store on the user package supports. When a batch of a particular colour is required, a supply of packages 11 is withdrawn from store, dyed, dried and delivered to the customer, all in a very short span of time. Indeed, a sample may be readily made up for customer approval before continuing with the whole order, and no stock need be built up that would ever need to be scrapped—at present, some ten per cent of dyed thread has to be scrapped because it turned out to be unsatisfactory as to its colour.

While particular reference has been made to sewing threads, it will be clear that other threads may be treated in similar fashion, and that other variations may be introduced without departing from the scope of the invention.

What is claimed is:

1. A method for manufacturing packages of dyed thread, comprising:

producing packages of undyed thread on user package supports which are dye permeable, the undyed thread being wound onto the user package supports in such a manner that the packages are suitable for dyeing and such that after dyeing the packages are suitable for orderly unwinding of the dyed thread in use;

holding the packages of undyed thread in store; and when a batch of a particular color of dyed thread is required, withdrawing a supply of the packages of undyed thread from said store and dyeing the thread on the user package supports to produce user packages of dyed thread;

whereby the packages of dyed thread are suitable for orderly unwinding in use.

2. A method according to claim 1, in which each package is wound at a density intermediate the densities of a normal dye package and a precision-wound user package.

3. A method according to claim 1, in which each package is wound as a precision wound package.

4. A method according to claim 1, in which each user package support comprises a perforated cone.

5. A method according to claim 1, in which each user package support comprises a perforated parallel-sided spool.

6. A method according to claim 5, in which the user package supports comprise a plurality of endwise-connected parallel sided spools on which adjacent packages are wound and which are readily separable into individual packages after dyeing.

7. A method according to claim 1, in which each user package support is reusable.

8. A method according to claim 1, in which each user package support is suitable for drying the thread after dyeing by radio frequency heating.

9. A method according to claim 1, in which each user package support is of plastics material.

10. A method according to claim 1, in which each user package support is of metal.

11. A method according to claim 1, in which the thread is wound on each support to a density of up to 0.8 grams per cubic centimetre.

12. A method according to claim 11, in which the thread is wound on each support to a density of between 0.7 and 0.8 grams per cubic centimetre.

13. A method according to claim 1, in which each wound package has a circumference of at least 160 mm.

14. A method according to claim 1, in which the thread is twice dyed, at least the second dyeing being effected on said supports.

15. A method according to claim 1, in which a finish is applied to the thread on said supports.

16. A method according to claim 15, in which the finish is applied together with the dye.

* * * * *

UNITED STATES PATENT AND TRADEMARK OFFICE

CERTIFICATE OF CORRECTION

PATENT NO. : 6,921,421 B2
DATED : July 26, 2005
INVENTOR(S) : Gailey et al.

It is certified that error appears in the above-identified patent and that said Letters Patent is hereby corrected as shown below:

Column 1,
Lines 3 and 4, cancel "This is a continuation of application Ser. No. PCT/GB01/00053, filed Jan. 8, 2001" and insert the following:

-- CROSS-REFERENCE TO RELATED APPLICATION

This application is a continuation of International Patent Application PCT/GB01/00053 filed January 8, 2001, currently pending, which application designated *inter alia* the United States and was published in English.

FIELD OF THE INVENTION --.

Between lines 6 and 7, after "sewing thread.", insert the following heading:

-- BACKGROUND OF THE INVENTION --.

Between lines 30 and 31, after "that address these concerns.", insert the following heading:

-- SUMMARY OF THE INVENTION --.

Column 2,
Between lines 2 and 3, after "package support.", insert the following heading:

-- BRIEF DESCRIPTION OF THE DRAWINGS --.

Between lines 18 and 19, after "machine spindle.", insert the following heading:

Figure 3:
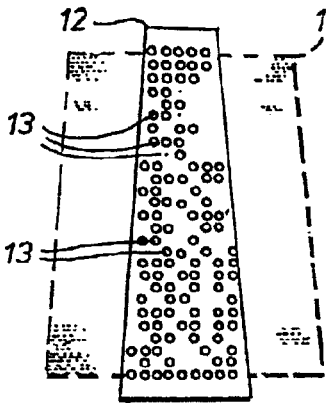
Figure 4:
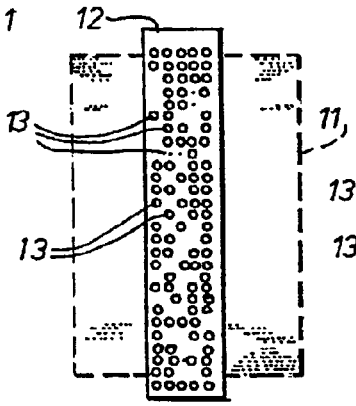
Figure 5:
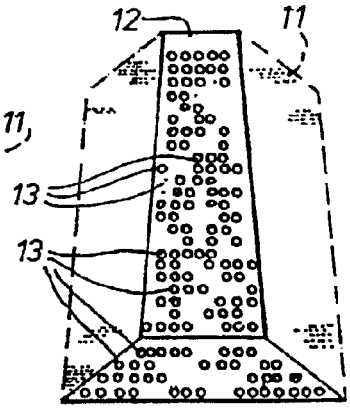
Figure 6:
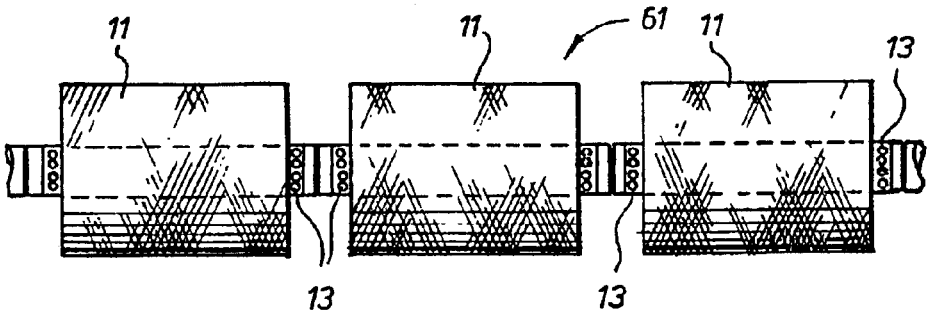
Figure 7:
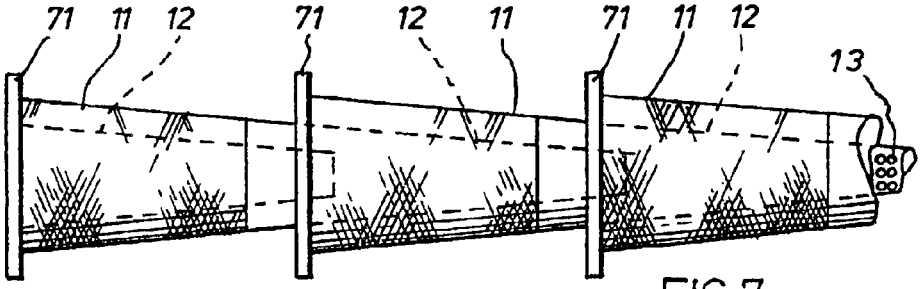

-- DETAILED DESCRIPTION OF PREFERRED EMBODIMENT --.

Signed and Sealed this

Tenth Day of January, 2006

JON W. DUDAS
*Director of the United States Patent and Trademark Office*